US007239837B2

(12) United States Patent
Hamada et al.

(10) Patent No.: US 7,239,837 B2
(45) **Date of Patent: *Jul. 3, 2007**

(54) FIXING APPARATUS

(75) Inventors: Yasuhide Hamada, Saitama (JP); Yuichiro Higashi, Kagoshima (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 12 days.

This patent is subject to a terminal disclaimer.

(21) Appl. No.: 10/691,548

(22) Filed: Oct. 24, 2003

(65) Prior Publication Data

US 2004/0081492 A1 Apr. 29, 2004

(30) Foreign Application Priority Data

Oct. 28, 2002 (JP) ..... 2002-312085

(51) Int. Cl.
*G03G 15/20* (2006.01)

(52) U.S. Cl. ..... 399/328

(58) Field of Classification Search ..... 399/320, 399/328–334

See application file for complete search history.

(56) References Cited

U.S. PATENT DOCUMENTS 6,763,218 B2 * 7/2004 Hamada et al. ..... 399/329

FOREIGN PATENT DOCUMENTS

| | | | |
|---|---|---|---|
| JP | 57005073 A | * | 1/1982 |
| JP | 08146800 A | * | 6/1996 |
| JP | 08160791 A | * | 6/1996 |
| JP | 2003057981 A | * | 2/2003 |

* cited by examiner

*Primary Examiner*—David M. Gray
*Assistant Examiner*—Ryan Gleitz
(74) *Attorney, Agent, or Firm*—Westerman, Hattori, Daniels & Adrian, LLP.

(57) ABSTRACT

The present invention provides a fixing apparatus includes a fixing roller 12, a heating source 14 for allowing the outer peripheral surface of the fixing roller 12 to have a given temperature capable of performing a fixing operation, a pressing roller 16 in rotational contact with the fixing roller 12, and a biasing member 18 for allowing the pressing roller 16 to be brought into press contact with the fixing roller 16 at a given pressure. The fixing apparatus is operable to allow a sheet with a surface supporting an unfixed toner thereon to pass through the rotational contact region along one direction so as to fix the unfixed toner onto the sheet. In this fixing apparatus, the fixing roller 12 is disposed on the side of the sheet surface supporting the unfixed toner, and the pressing roller 16 is disposed on the opposite side of the fixing roller 12 with respect to the sheet. Further, the biasing member 18 is adapted to apply a biasing force to the pressing roller in a direction Y intersecting with an axis X connecting the respective center positions of the fixing roller 12 and the pressing roller 16.

25 Claims, 11 Drawing Sheets

FIXING APPARATUS

FIELD OF THE INVENTION

The present invention relates to a fixing apparatus for heating and pressing an unfixed toner on a sheet to fix the toner onto the sheet. The fixing apparatus is usable in copiers, printers, facsimile machines or the like.

BACKGROUND OF THE INVENTION

A so-called two-roller type fixing apparatus is typical used in recent electrophotographic systems. The two-roller type fixing apparatus comprises a fixing roller having thereinside a halogen lamp serving as heat-generating means, a pressing roller in rotational contact with the fixing roller, and a biasing member for allowing the pressing roller to be brought into press contact with the fixing roller at a given pressure. The two-roller type fixing apparatus is operable to allow a sheet with a surface supporting an unfixed toner thereon to pass through the rotational contact region along one direction so as to fix the unfixed toner onto the sheet.

In the two-roller type fixing apparatus having the above structure, the area of the rotational contact region is inherently apt to be increased as the fixing apparatus is increased in size, for example, in fixing apparatuses compatible with A-3 size sheets (or A4 cross-feed). In addition, when the fixing apparatus is designed to provide a wider nip width for achieving enhanced fixing performance, it is required to fairly increase a spring force which acts on both ends of the pressing roller.

The increased spring force can cause axial recurvation in the pressing roller itself and axially uneven press-contact force between the pressing and fixing rollers, resulting in deteriorated fixing performance against the intended purpose.

Further, if the press-contact force between the pressing and fixing rollers is increased, the increased press-contact force will act as an additional load against the rotation of the fixing roller, which leads to increased driving force, resulting in increase in apparatus size and/or energy consumption.

Various problems are involved in the above method of assuring the press-contact force by the increased spring force to provide a wider nip width. Thus, there is a strong need for providing an improved fixing apparatus free from such problems.

SUMMARY OF THE INVENTION

In view of the above circumstances, it is therefore an object of the present invention to provide a fixing apparatus capable of increasing a nip width with a small load.

It is another object of the present invention to provide a fixing apparatus capable of downsizing the apparatus and/or saving energy, while increasing a nip width. In order to achieve the above objects, the present invention provides a fixing apparatus comprising a fixing roller, heating means for allowing the outer peripheral surface of the fixing roller to have a given temperature capable of performing a fixing operation, a pressing roller in rotational contact with the fixing roller, and a biasing member for allowing the pressing roller to be brought into press contact with the fixing roller at a given pressure. The fixing apparatus is operable to allow a sheet with a surface supporting an unfixed toner thereon to pass through the rotational contact region along one direction so as to fix the unfixed toner onto the sheet. In this fixing apparatus, the fixing roller is disposed on the side of the sheet surface supporting the unfixed toner, and the pressing roller is disposed on the opposite side of the fixing roller with respect to the sheet. Further, the biasing member is adapted to apply a biasing force to the pressing roller in a direction intersecting with an axis connecting the respective center positions of the fixing roller and the pressing roller.

The fixing apparatus of the present invention may satisfy the formula: $+5° < \theta < +80°$. In this formula, $\theta$ is an angle defined between X and Y, wherein the X is an axis connecting the respective centers of the fixing and pressing rollers, and the Y is an axis along a direction in which the pressing roller is biased toward the fixing roller in the rotational contact region. Further, a positive sign assigned to the angle $\theta$ means that the angle $\theta$ is defined between the axis X and the axis Y located on a sheet-feeding side with respect to the axis X.

Alternatively, the fixing apparatus of the present invention, may satisfy the formula: $-5° < \theta < -80°$. In this formula, $\theta$ is an angle defined between X and Y, wherein the X is an axis connecting the respective centers of the fixing and pressing rollers, and the Y is an axis along a direction in which the pressing roller is biased toward the fixing roller in the rotational contact region. Further, a negative sign assigned to the angle $\theta$ means that the angle $\theta$ is defined between the axis X and the axis Y located on a sheet-discharging side with respect to the axis X.

In the fixing apparatus according to one specific embodiment of the present invention, the fixing roller and the pressing roller may be composed of a hard roller and an elastic roller, respectively. The fixing apparatus may further include releasing means for releasing the sheet attached on the outer peripheral surface of the fixing roller after passing through the rotational contact region, from the outer peripheral surface of the fixing roller. The releasing means may be disposed in contact with the outer peripheral surface of the fixing roller. Alternatively, the releasing means may be disposed opposed to the outer peripheral surface of the fixing roller in a non-contact manner.

In this embodiment, the elastic roller may include a core, and a thick layer made of silicone rubber and formed on the outer periphery of the core.

Further, in this embodiment, the heating means may include a heater embedded in the fixing roller to heat the outer peripheral surface of the fixing roller from the inside of the fixing roller.

In the fixing apparatus according to another embodiment of the present invention, each of the fixing roller and the pressing roller may be composed of an elastic roller. The fixing roller may have the same elasticity as that of the pressing roller to allow the rotational contact region to be formed as a 2-dimensional configuration. Alternatively, the fixing roller may have a higher elasticity than that of the pressing roller.

In this embodiment, each of the fixing roller and the pressing roller may include a core, and a thin layer made of silicone rubber and formed on the outer periphery of corresponding the core.

In this case, the heating means may include a heater embedded in the fixing roller to heat the outer peripheral surface of the fixing roller from the inside of the fixing roller. Further, the heating means may include an auxiliary heater embedded in the pressing roller to heat the sheet which is passing through the rotational contact region, from the sheet surface having no unfixed toner.

In the fixing apparatus according to still another embodiment of the present invention, the fixing roller and the pressing roller may be composed of an elastic roller and a hard roller, respectively. The fixing roller may include a core, and a thick layer made of silicone rubber and formed on the outer periphery of the core.

In this embodiment, the heating means may include at least one heating roller in rotational contact with the outer peripheral surface of the fixing roller to heat the outer peripheral surface of the fixing roller from the outside of the fixing rollel The heating roller may include a metal sleeve, and a heater housed in the sleeve. The heating means may further include an auxiliary heater embedded in the pressing roller to heat the sheet which is passing through the rotational contact region, from the sheet surface having no unfixed toner.

In the fixing apparatus according to yet another embodiment of the present invention, the fixing roller may include a core, an elastic layer formed on the outer periphery of the core, and a thin metal sleeve formed on the outer periphery of the elastic layer. The heating means may include an induction-heating device disposed opposed to the outer peripheral surface of the fixing roller in a non-contact manner to induction-heat the thin metal sleeve.

In the fixing apparatus according to another further embodiment, the metal sleeve may be made of electroformed nickel material.

In the fixing apparatus according to still a further embodiment of the present invention, the fixing roller may include a core, an elastic layer disposed on the outer periphery of the core, and a thin sleeve disposed on the outer periphery of the elastic layer and made of synthetic resin material which dispersedly contains a material for generating heat therein through electromagnetic induction, and the heating means may include an induction-heating device disposed opposed to the outer peripheral surface of the fixing roller in a non-contact manner to induction-heat the thin sleeve. The synthetic resin material may be polyimide resin.

DESCRIPTION OF THE PREFERRED EMBODIMENT

With reference to the accompanying drawings, a fixing apparatus according to a first embodiment of the present invention will now be described in detail.

General Description of Fixing Apparatus 10

Figure 1:
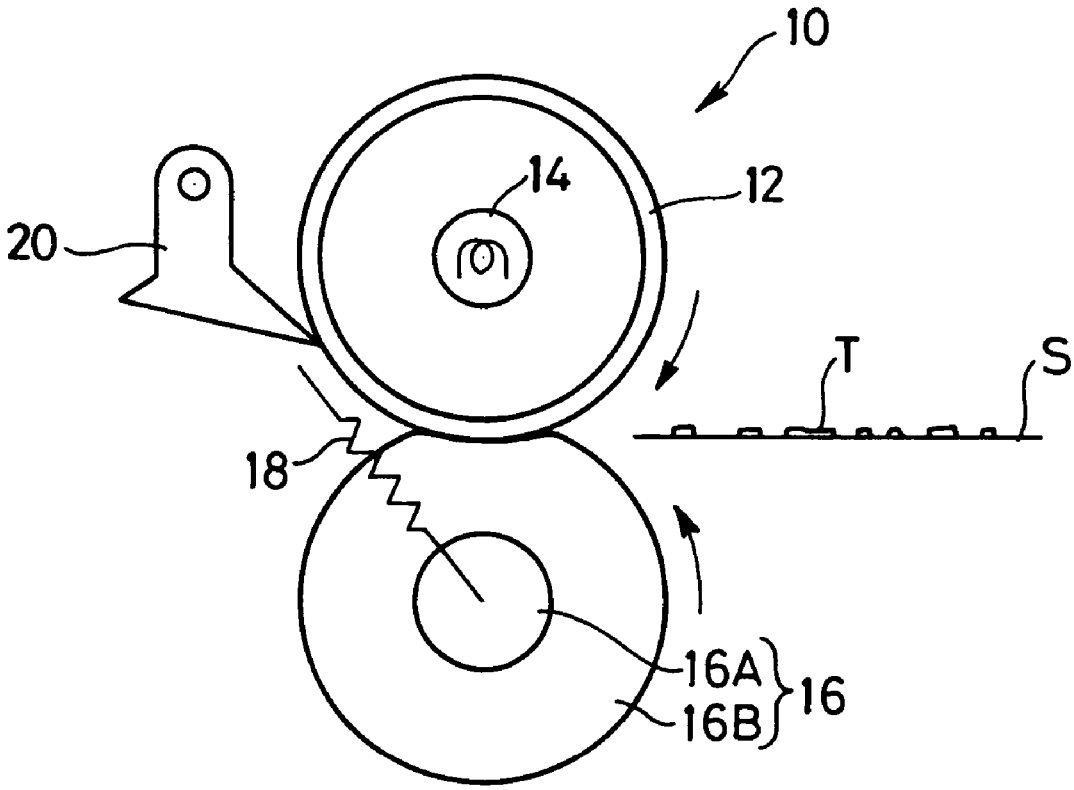
FIG. 1 is a sectional front view showing the structure of a fixing apparatus according to a first embodiment of the present invention.

As shown in FIG. 1, a fixing apparatus 10 according to a first embodiment comprises a fixing roller 12, a heating source 14 serving as heating means for allowing the outer peripheral surface of the fixing roller 12 to have a given temperature capable of performing a fixing operation, a pressing roller 16 in rotational contact with the fixing roller 12, and a biasing member 18 for allowing the pressing roller 16 to be brought into press contact with the fixing roller 12 at a given pressure and along a given direction as described later. The fixing apparatus 10 is operable to allow a sheet S with a surface supporting an unfixed toner T to pass through the rotational contact region between the fixing roller 12 and the pressing roller 16 along one direction so as to fix the unfixed toner onto the sheet S.

In FIG. 1 drafted as a front view, the unfixed sheet S having an upper surface supporting the unfixed toner is fed from the right side to the left side of the figure through a feeding mechanism (not shown), as described in detail later.

Both ends of the rotation shaft of the pressing roller 16 is rotatably supported by a mounting bracket (not shown) swingable along the biasing direction of the biasing member 18.

In this embodiment, the heating source 14 is composed of a heating device, such as a halogen lamp, provided inside the fixing roller 12.

The pressing roller 16 is composed of an elastic roller, and the fixing roller 12 is composed of a hard roller. The biasing member 18 is composed of a pair of coil springs. Each of the coil springs has one end engaged with corresponding one of both ends of the rotation shaft of the pressing roller 16 protruding from the swingable bracket rotatably supporting the rotation shaft, and the other end engaged with a housing (not shown). The pressing roller 16 is biased by the coil springs to press-contact the fixing roller 12 along a direction intersecting with an axis connecting the respective center positions of the fixing roller 12 and the pressing roller 16.

Thus, in the rotational contact region (nip region) between the fixing roller 12 and the pressing roller 16, the pressing roller 16 rotationally contacts the fixing roller 12 at a given press-contact force, so that it is deformed to provide a concave surface in the rotational contact region so as to assure a sufficient nip width.

A releasing pawl 20 is disposed in slidable contact with the outer peripheral surface of the fixing roller 12 to release the sheet S which has been attached onto the outer peripheral surface after the fixing operation. Thus, even if the sheet S is attached onto the outer peripheral surface after the fixing operation, the releasing pawl 20 can reliably release the sheet to effectively prevent sheet jamming from occurring.

The leading edge of the unfixed sheet fed toward the fixing apparatus 10 through the feeding mechanism is first brought into contact with the upper surface of a feed guide plate (not shown), and fed obliquely upward along the upper surface of the feed guide plate. The feed guide plate guides the unfixed sheet S to bring the leading edge of the unfixed sheet S into contact with the outer peripheral surface of the pressing roller 16. Then, the unfixed sheet S is moved along the outer peripheral surface of the pressing roller 16, and introduced to the rotational contact region between the fixing roller 12 and the pressing roller 16.

In the fixing apparatus 10 schematically constructed as described above, when the unfixed sheet S is fed on the feed guide plate through the feeding mechanism, the feed guide plate 38 contacts and supports the back surface of the unfixed sheet S having no unfixed toner thereon.

Then, the unfixed sheet S is guided toward the rotational contact region (nip region) between the fixing roller 12 and the pressing roller 16, and compressedly passed through between the fixing and pressing rollers 12, 16 to allow the unfixed toner to be thermo-compression-bonded and fixed onto the sheet.

The above structural elements will be individually described below.

Fixing Roller 12

In the first embodiment, the fixing roller 12 is constructed as a hard roller including a core formed of an iron pipe having a diameter of 36 mm and a wall thickness of 0.5 mm, and a PTFE coating layer coated over the outer periphery of the core at a thickness of 20 μm. Thus, the core has a thin wall to provide a reduced warming-up period of the fixing roller. Both ends of a rotation shaft of the fixing roller 12 are rotatably supported by the housing through bearings (not shown).

The heating source 14 serving as heat generating means is embedded in the fixing roller 12. In the first embodiment, the heating source 14 is composed of a halogen lamp having a maximum power of 800 W.

Pressing Roller 16

The pressing roller 16 comprises a core 16A having a rotation shaft rotatably supported by a bracket through bearings, and a thick roller body 16B coaxially formed on the periphery of the core 16A. In the first embodiment, the outer diameter of the pressing roller 16 is set at 35.0 mm. In the first embodiment, the core 16A is formed of an iron pipe having a diameter of 20 mm, and the roller body 16B is formed of an elastic body made of silicone rubber (specifically, silicone sponge having an ASKER C hardness of 42 degree on a roller) and attached on the outer periphery of the core 16A at a thickness of 7.5 mm.

Direction of Biasing Force of Pressing Roller 16 Toward Fixing Roller 12

Figure 2:
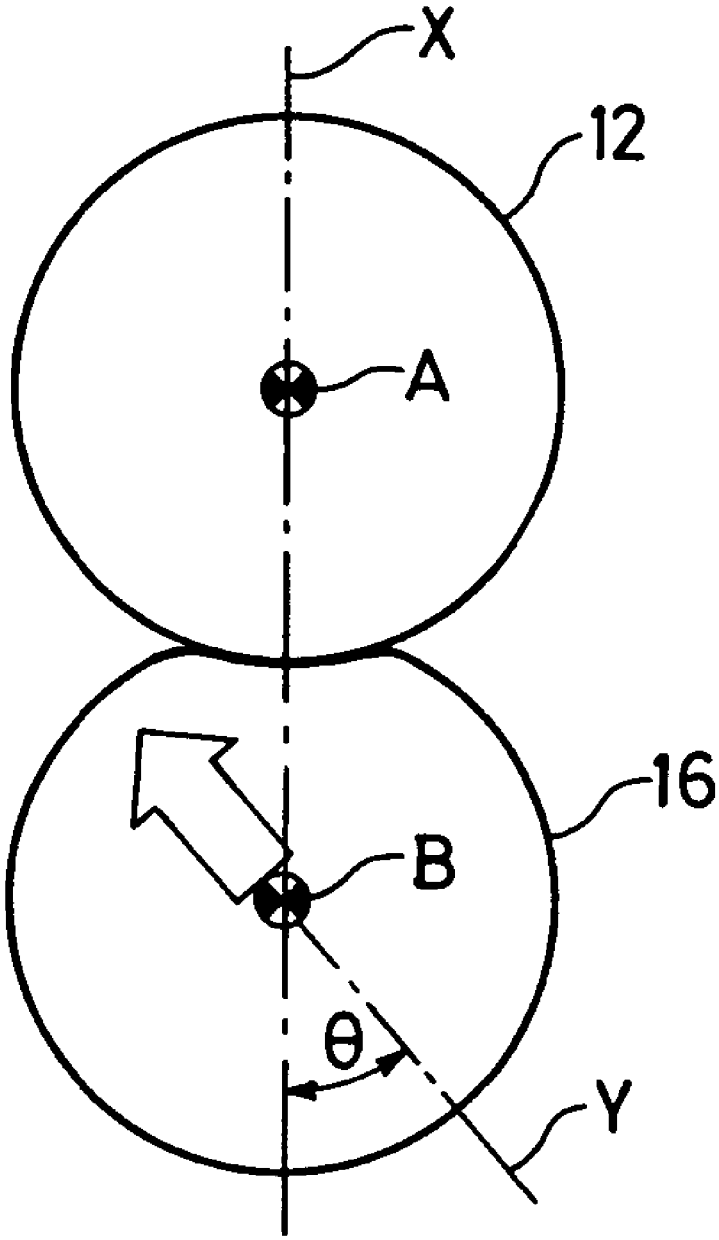
FIG. 2 is a schematic diagram showing an inclined pressing state in the fixing apparatus in FIG. 1.

As shown in FIG. 2, in the first embodiment, given that an axis connecting the center A of the fixing roller 12 and the center B of the pressing roller 16 is X, and an axis along a direction in which the pressing roller 16 is biased toward the fixing roller 12 in the rotational contact region is Y, an angle θ defined between the axis X and the axis Y is set at +48° (plus 48 degrees), or in an inclined pressing state (wherein a positive sign assigned to the angle θ means that the angle θ is defined between the axis X and the axis Y located on a sheet-feeding side with respect to the axis X, and a negative sign assigned to the angle θ means that that the angle θ is defined between the axis X and the axis Y located on a sheet-discharging side with respect to the axis X).

Thus, as compared to the state when the pressing roller 16 is straightly in rotational contact with the fixing roller 12 (that is, the angle θ is zero degree, or the axis Y is aligned with the axis X, or a vertical pressing state), the pressing roller 16 in the first embodiment rotationally contacts the fixing roller 12 while being displaced (slanted) toward the sheet-feeding side from which the unfixed sheet is fed in.

Thus, the nip width in the rotational contact region can be increased by allowing the press-contact direction of the pressing roller 16 to the fixing roller 12 to be slanted toward the unfixed-sheet feeding side. That is, according to this structure, a desired nip width can be obtained by a lower biasing force of the biasing member 18 (spring force) than that required for obtaining the same nip width from the pressing roller 16 straightly in rotational contact with the fixing roller 12.

Therefore, the fixing apparatus according to the first embodiment can reliably solve the conventional problem in which the increased biasing force (spring force) causes axial recurvation in the pressing roller 16 itself and axially uneven press-contact force between the pressing and fixing rollers, resulting in deteriorated fixing performance against the intended purpose.

The fixing apparatus according to the first embodiment can also reliably solve the conventional problem in which the increased press-contact force between the pressing and fixing rollers 16, 12 acts as an additional load against the rotation of the fixing roller, which leads to the increased driving force of the fixing roller, resulting in increase in apparatus size and/or energy consumption.

Determination of Optimum Range of Angle T

An optimum range of the angle θ will be determined as follows.

Figure 3:
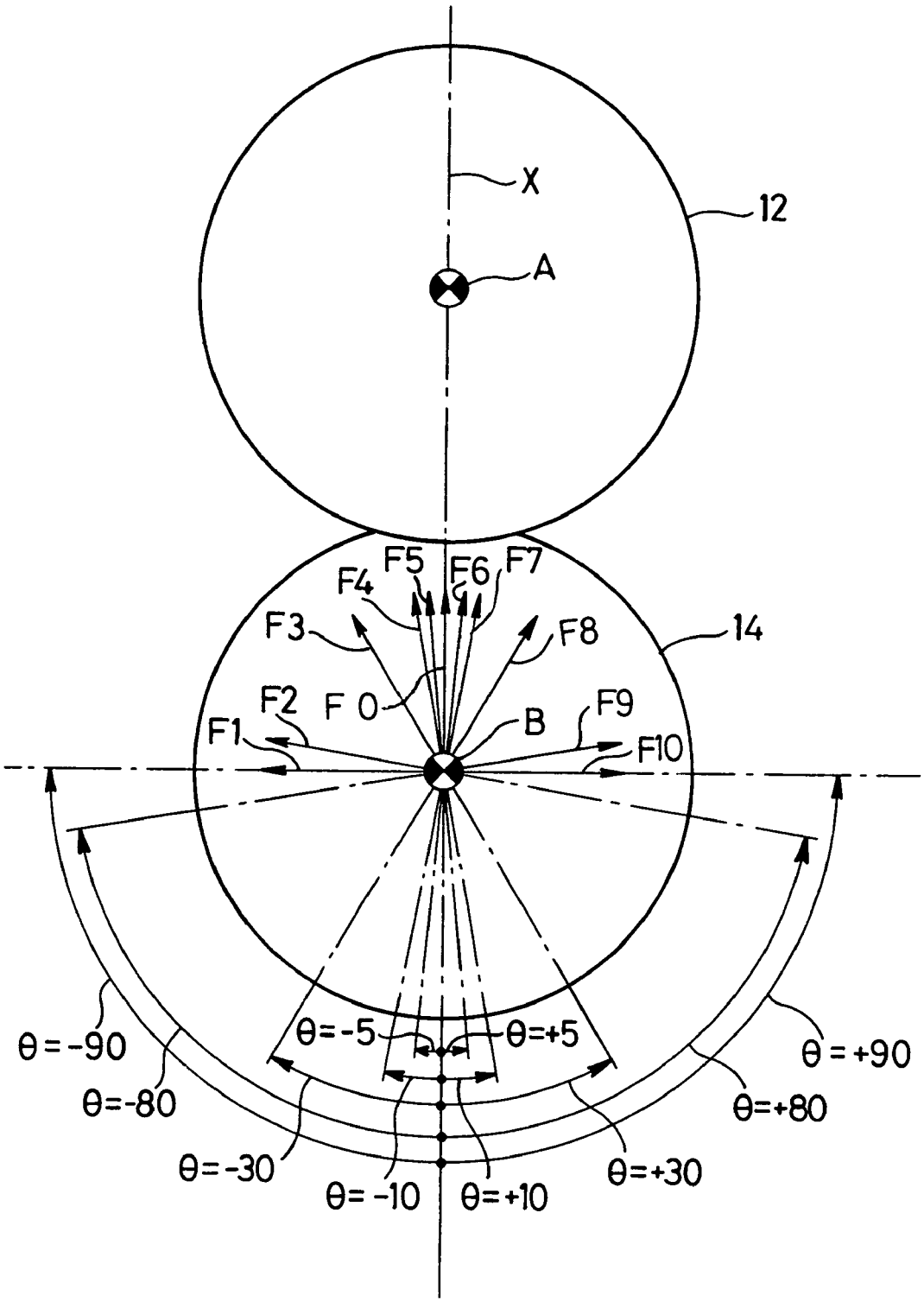
FIG. 3 is an explanatory diagram of the definition of an angle θ.

For determining the optimum range, the angle θ was variously set in range of +90 degrees to −90 degrees by changing the biasing direction of the biasing member 18, as shown in FIG. 3.

Specifically, as Test Example 1, the respective required pressing forces for the variously changed angles θ were determined under the condition that the nip width is kept in a constant value (e.g. 7 mm). As Test Example 2, the variation of nip width to be caused by variously changing the angle θ was determined under the condition that the pressing force is kept in a constant value (e.g. 26 kgf/end). As Test Example 3, the relationship between a nip width and a temperature required for performing the fixing operation was determined.

Figure 4:
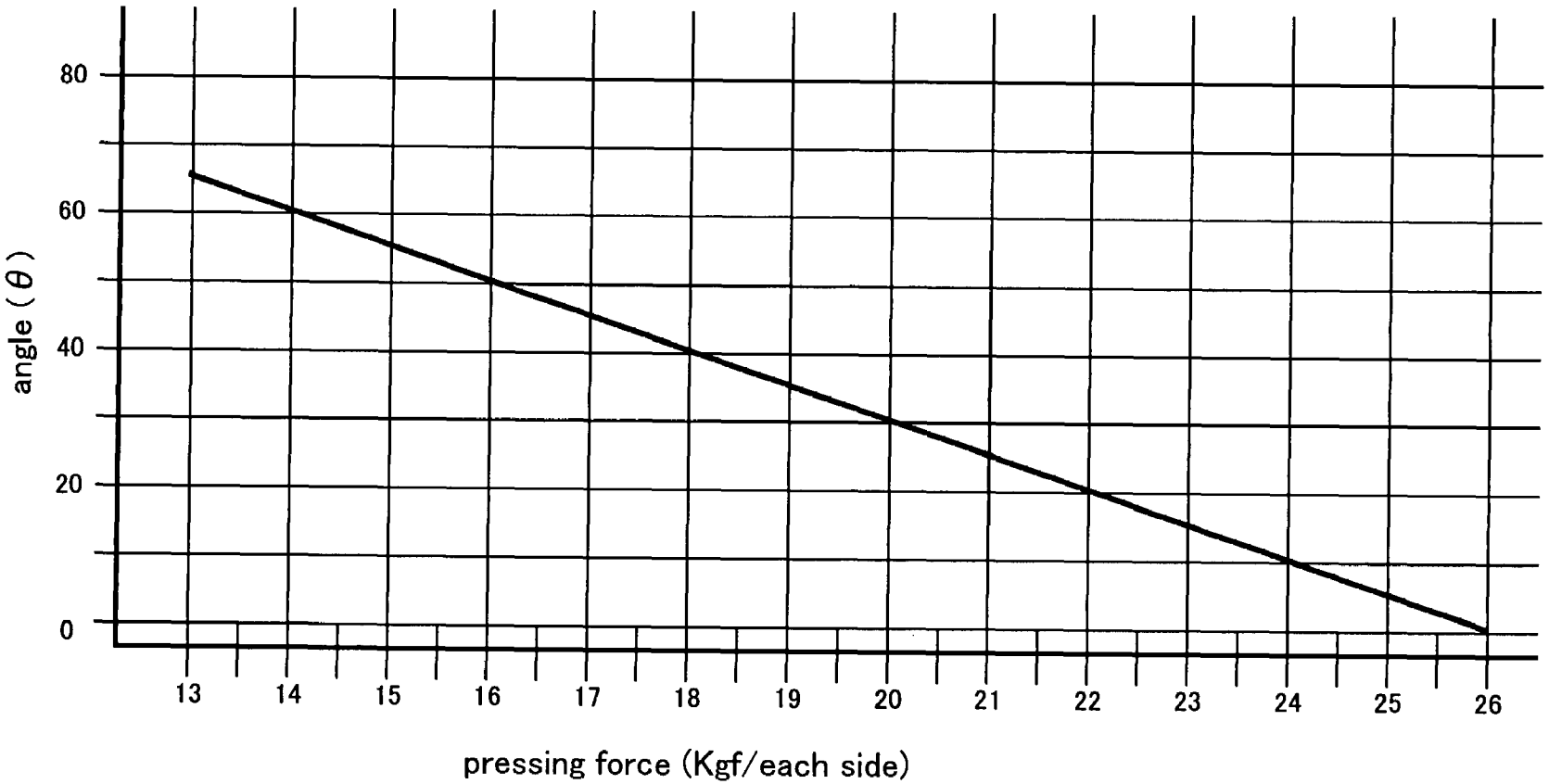
FIG. 4 is a diagram showing the relationship between the angle θ and a pressing force under the condition that a nip width is kept in a constant value.
Figure 5:
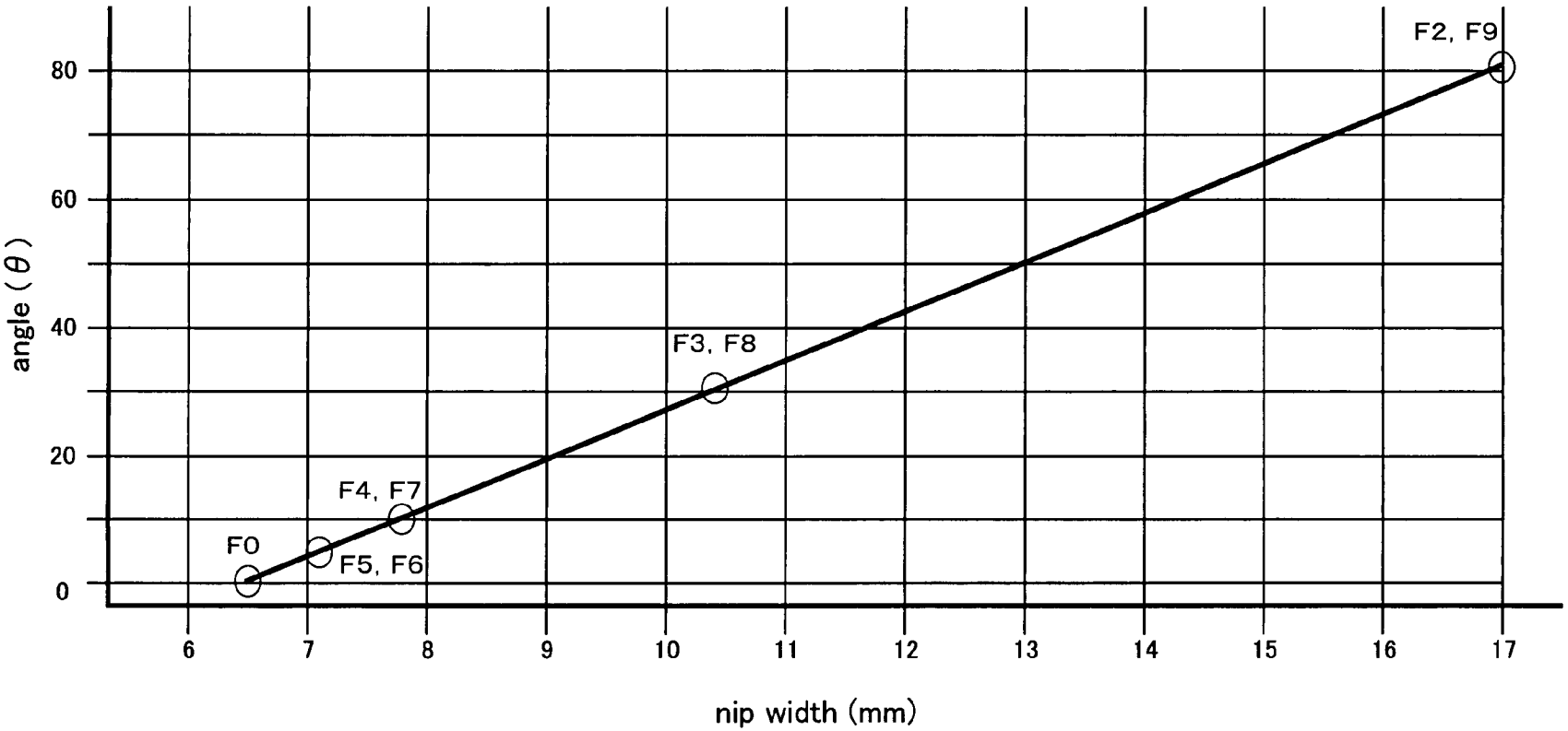
FIG. 5 is a diagram showing the relationship between the angle θ and the nip width under the condition that the pressing force is kept in a constant value.
Figure 6:
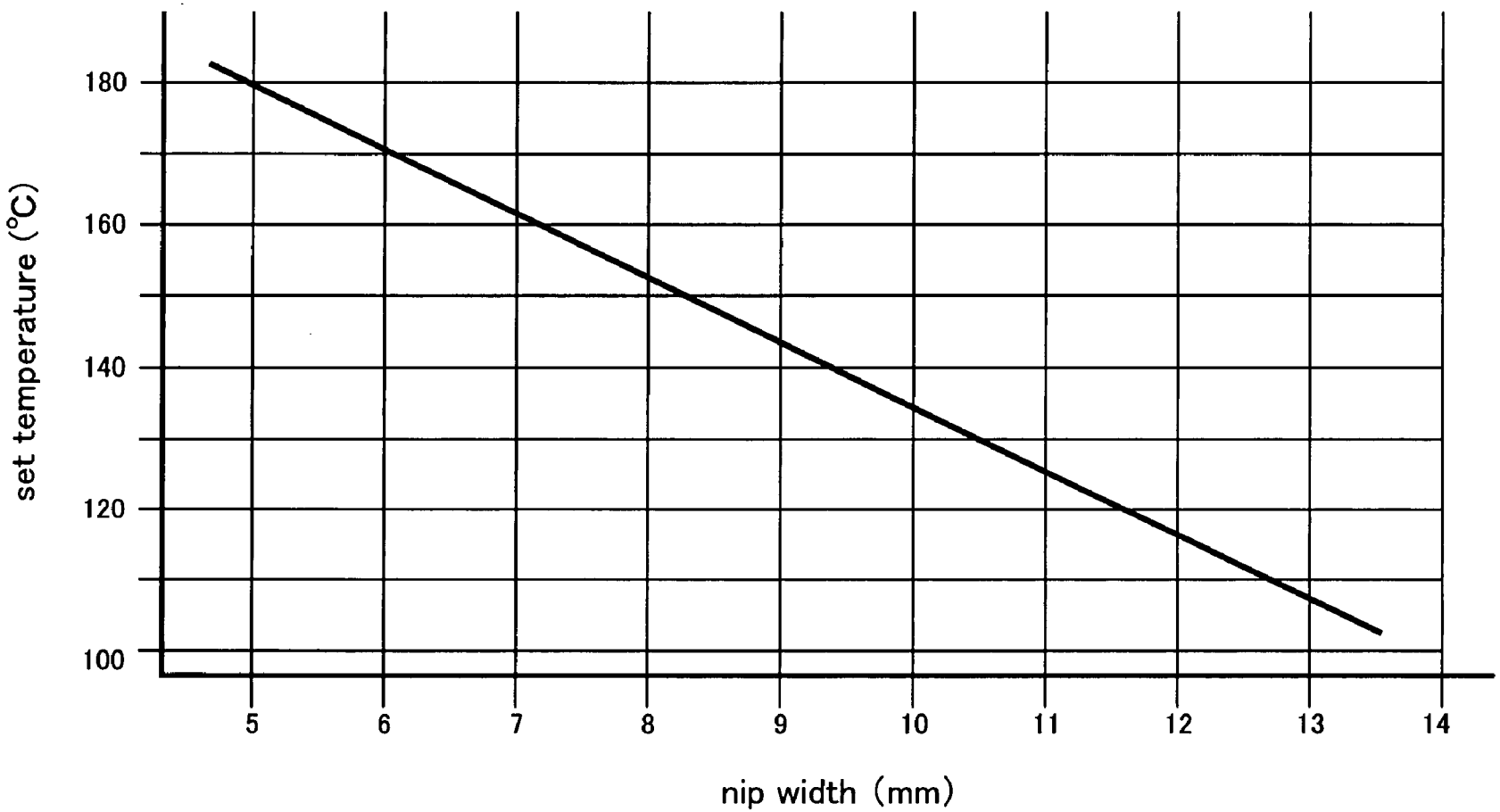
FIG. 6 is a diagram showing the relationship between the nip width and a set temperature required for a fixing operation.

FIGS. 4, 5 and 6 show the results of Test Examples 1, 2 and 3, respectively.

As seen in the result of FIG. 4, while 26 kgf/end of pressing force is required to obtain a nip width of 7 mm in the vertical pressing state (angle θ=zero degree), a required pressing force in the inclined pressing state can be reduced in proportion to the increase of the angle θ in either of the plus and minus directions.

As seen in the result of FIG. 5, when any amount of the angle θ is set in either of the plus and minus directions under the condition that the pressing force is kept in a constant value, for example 26 kgf/end, a nip width to be obtained in the vertical pressing state is increased from 6.5 mm of nip width in zero degree of angle θ or the vertical pressing state, in proportion to the increase of the angle θ (or the level of the inclined pressing state).

Thus, an increased nip width can be reliably obtained with the same pressing force by changing the conventional vertical pressing state into the inclined pressing state of the present invention. As seen in the result of FIG. 6, the increased nip width allows a set temperature required for the fixing operation to be reduced as compared to that in the vertical pressing state so as to achieve energy saving.

Further, as seen in the result of FIG. 4, if the condition of keeping the nip width in the same value is accepted, the required pressing force can be more reduced than that in the vertical pressing state to provide a directly downsized fixing apparatus, and the driving force of the fixing roller can also be reduced as the pressing force is reduced to achieve energy saving.

The upper limit of the optimum range of the angle θ is determined under the condition that the rotational contact between the fixing roller 12 and the pressing roller 16 or the formation of the nip region is assured at any angle θ to be arranged. In view of this condition, the upper limit of the optimum range of the angle θ is 80 degrees in absolute value.

While the upper limit of the optimum range of the angle θ is theoretically any value except for zero degree, it is determined as 5 degrees in consideration of an actual angular range of zero degree ±5 degrees in the vertical pressing state.

Thus, the optimum range of the angle θ for achieving the inclined pressing state as the future of the present invention is determined in the range of plus 5 degrees to plus 80 degrees or in the range of minus 5 degrees to minus 80 degrees.

The angle θ of the first embodiment is set at +48 degree falling within the above the optimum range.

As described above, according to the present invention, given that a positive sign is assigned to the angle θ when the biasing axis Y of the pressing roller 16 toward the fixing roller 12 is located on the sheet-feeding side with respect to the axis X connecting the respective centers of the fixing roller 12 and the pressing roller 16, and a negative sign is assigned to the angle θ when the biasing axis Y is located on the sheet-discharging side with respect to the axis X, the angle θ defined between the axis X and the axis Y is set in the inclined-pressing range of −5 degrees to −80 degrees or +5 degrees to +80 degrees. Thus, as compared to the vertical pressing state when the pressing roller 16 is straightly in rotational contact with the fixing roller 12, the pressing roller 16 rotationally contacts the fixing roller 12 while being displaced (slanted) toward the sheet-discharging side or the sheet-feeding side.

In this way, the nip width in the rotational contact region between the fixing roller 12 and the pressing roller 16 can be increased as compared to the vertical compression state under substantially the same pressing force. If it is attempted to obtain a desired image quality or temperature-rising characteristic under substantially the same nip width, the pressing force can be reduced to provide significant advantages of downsizing the fixing apparatus and/or suppressing the required power for the driving mechanism.

When the fixing roller has a thick elastic layer, and the angle θ is set in the minus range, the pressing force on the unfixed sheet-discharging side in the rotational contact region is increased more than that on the unfixed sheet-feeding side, in a microscopic observation of the press contact state of the pressing roller 16 against the fixing roller 12 in the rotational contact region.

Thus, in the rotational contact region, the pressing force on the unfixed sheet-discharging side can be set higher than that on the unfixed sheet-feeding side by setting the angle θ in the minus range to allow the press-contact direction of the pressing roller 16 against the fixing roller 12 to be slanted toward the unfixed-sheet discharging side. According to this structure, a sheet-releasing performance of releasing the fixed sheet from the fixing roller 12 can be significantly improved to provide an additional advantage of releasing the fixed sheet from the fixing roller 12 without providing any releasing pawl.

As described in detail, according to the first embodiment, a wide nip width can be advantageously formed with a smaller pressing force than that in the conventional fixing apparatus by setting the angle θ in the above manner to establish the inclined pressing state.

It is understood that the present invention is not limited to the structure of the above embodiment, but various modifications can be made without departing from the spirit and scope of the present invention.

For example, while an oil-applying roller for applying releasing oil on the outer peripheral surface of the fixing belt 12 has not been described in the above embodiment, the present invention is not limited to the structure devoid of the oil-applying roller, but any suitable oil-applying roller may be incorporated into the structure of the present invention.

Further, while the above embodiment has described the core 24*a* of the fixing roller 12 formed of an iron pipe, the present invention is not limited to this structure, but the core 24*a* may be formed of a pipe made of aluminum or stainless steel such as SUS.

Further, while the above embodiment has described the fixing roller 12 provided with only the heating source 14 embedded therein as heat-generating means, the present invention is not limited to this structure, but a second heating source may be additionally embedded in the pressing roller 16. In this case, the second heating source may be compose of a halogen lamp, for example, of 250 W, having a lower maximum power than the heating source 14 embedded in the fixing roller 12.

It is to be understood that a sheet or film-shaped heat-generating body may be used as the heating source 14, as a substitute for the halogen lamp. That is, any suitable type or shape of heat-generating means may be used.

Figure 7:
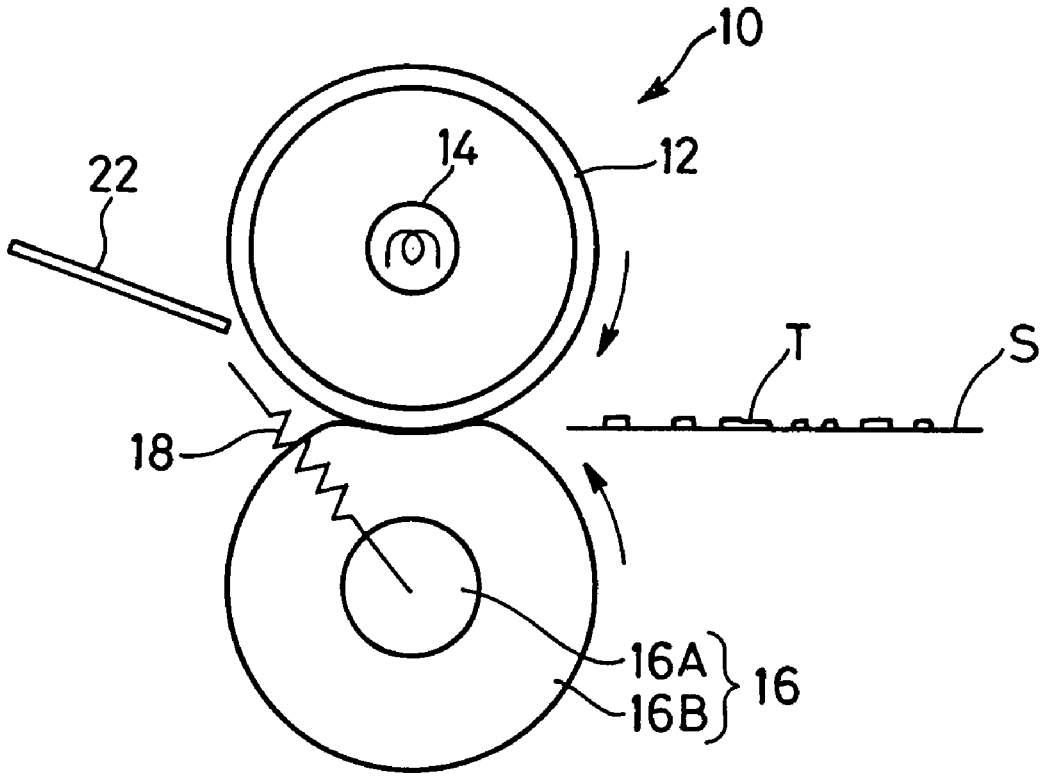
FIG. 7 is a front view showing a modification of a releasing pawl of the fixing apparatus in FIG. 1.

Further, while the above embodiment has described the releasing pawl 20 disposed in slidable contact with the outer peripheral surface of the fixing roller 12 to release the sheet S attached thereto after the fixing operation, the present invention is not limited to this structure. For example, as shown in FIG. 7, the releasing pawl may be modified as a releasing plate 22 disposed opposed to the outer peripheral surface of the fixing roller 12 in a non-contact (non-slidable-contact) manner. In this case, the front edge of the releasing plate 22 is spaced apart from the outer peripheral surface of the fixing roller 12 at a distance in the range of about 0.1 mm to 1.0 mm.

Thus, the structure for releasing the sheet S from the outer peripheral surface of the fixing roller 12 may be either one of the structure in contact with the outer peripheral surface of the fixing roller 12 as described in the aforementioned embodiment, and the structure disposed in a non-contact manner as described in the above modification.

No unfixed toner is practically attached on the leading edge region of the sheet S in a solid state. Even if the unfixed toner attached on the sheet other than the leading edge region is attached onto the outer peripheral surface of the fixing roller 12 due to the heat and pressure applied thereto when passing through the rotational contact region, the leading edge region will be distanced from the outer peripheral surface of the fixing roller 12 without attachment thereto. Thus, a function of releasing the sheet S can be obtained even in a non-contact manner by disposing the front edge of the releasing plate 22 at a position where the leading edge region can be caught on the front edge.

Figure 8:
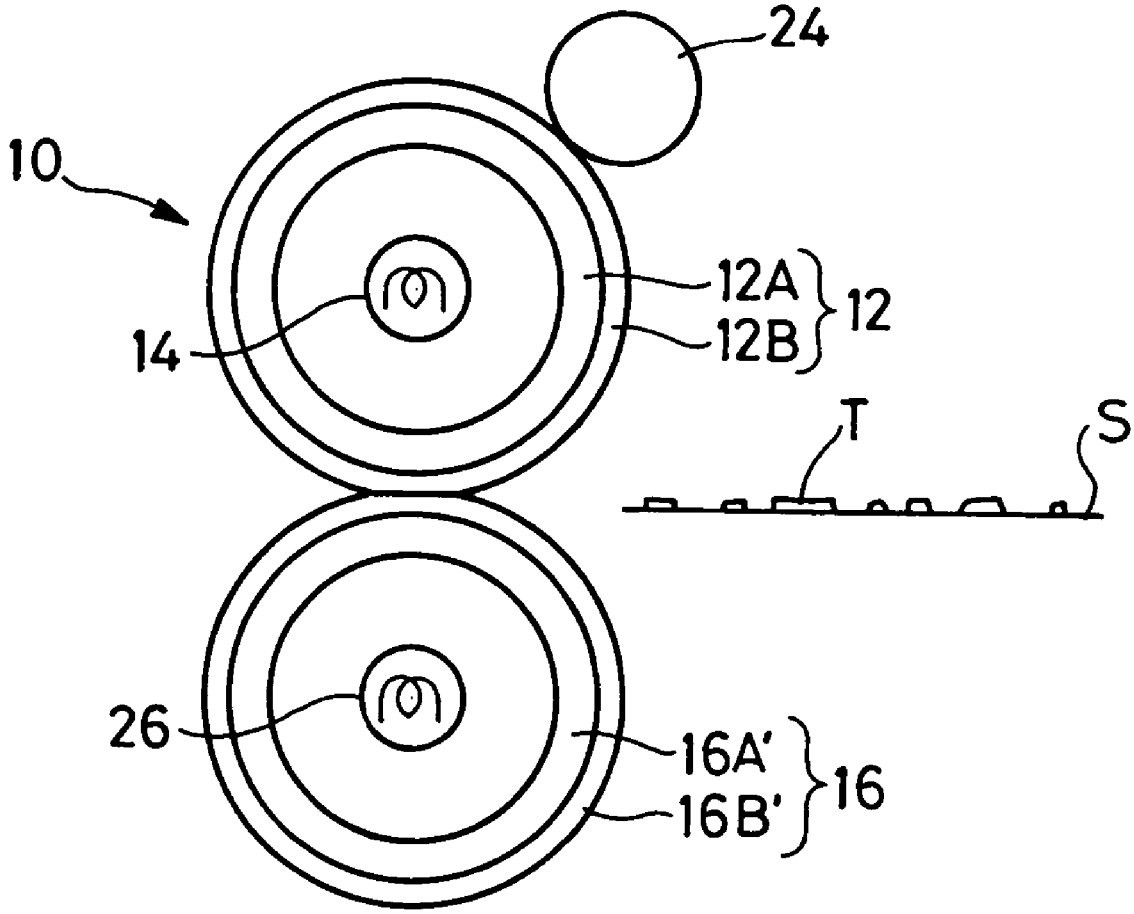
FIG. 8 is a sectional front view showing the structure of a fixing apparatus according to a second embodiment of the present invention.

Further, while the first embodiment has described the fixing roller 12 composed of a hard roller and the pressing roller 16 composed of an elastic roller, the present invention is not limited to this structure, but both the fixing roller 12 and the pressing roller 16 may have substantially the same elasticity as shown in a second embodiment in FIG. 8.

More specifically, in the second embodiment, each of a fixing roller 12 and a pressing roller 16 commonly includes a thin-walled core 12A, 16A', and a thin elastic layer 12B, 16B made of silicone rubber and formed on the outer periphery of the core 12A, 16A' at a thickness of 1 mm to 2 mm. In the second embodiment, the respective rubber hardnesses of the thin elastic layers 12B, 16B are set at the same value.

As with the first embodiment, a heating source 14 is contained in the fixing roller 12 to heat the fixing roller from the inside thereof so as to allow the outer peripheral surface of the fixing roller 12 to have a given temperature capable of performing a fixing operation. The pressing roller 16 may also contain an auxiliary heating source 26 having the same structure as that of the heating source 14 embedded in the fixing roller 12, to heat a sheet S which is passing through the rotational contact region, from a surface (lower surface in FIG. 8) of the sheet having no unfixed toner thereon. The auxiliary heating source 26 can increase the amount of heat to be applied to the unfixed toner, and a heat amount required for fixing the unfixed toner when the sheet S passes through the rotational contact region can be reliably supplied to the sheet S even if the feed speed of the sheet S is increased. Thus, the speed of the entire fixing and image forming process can be increased.

An anti-offset-oil-applying roller 24 is also disposed in rotational contact with the outer peripheral surface of the fixing roller 12 to apply anti-offset oil onto the outer peripheral surface thinly and evenly according to the rotation of the fixing roller 12.

According to the above structure, the rotational contact region in the second embodiment is formed as an approximately 2-dimensional nip shape (or so-called "parallel nip" parallel to the feeding direction of the sheet S). Thus, the anti-offset oil simply applied through the oil-supplying roller 24 prevents the fixed sheet S from attaching onto the outer peripheral surface of the fixing roller 12 to allow the fixed sheet S to reliably pass through the rotational contact region without providing any releasing pawl 22.

While the second embodiment has described the respective thin elastic layers 12B, 16B' of the fixing and pressure rollers 12, 16 having the same rubber hardness, the present invention is not limited to this structure. For example, in one modification of the second embodiment, the thin elastic layer 12B of the fixing roller 12 may have a lower rubber hardness than that of the thin elastic layer 16B' of the pressing roller 16 to provide a nip region having an upward convex shape.

According to the above modification of the second embodiment, the sheet S passing through the rotational contact region formed in the upward convex shape has a tendency (property) of curving downwardly when discharged. Thus, the sheet S can be reliably released from the outer peripheral surface of the fixing roller 12 without using any releasing pawl even if no oil or a minimized amount of oil is applied from the oil-applying roller 24.

In the first embodiment, the halogen lamp serving as the heating source 12 is contained in the fixing roller 12 to heat the outer peripheral surface of the fixing roller 12 up to the given fixing temperature, from the inside of the fixing roller. However, the present invention is not limited to this structure, but the outer peripheral surface of the fixing roller 12 may be heated from the outside of the fixing roller.

Third and fourth embodiments constructed to heat the outer peripheral surface of the fixing roller 12 from the outside of the fixing roller will be described below.

Figure 9:
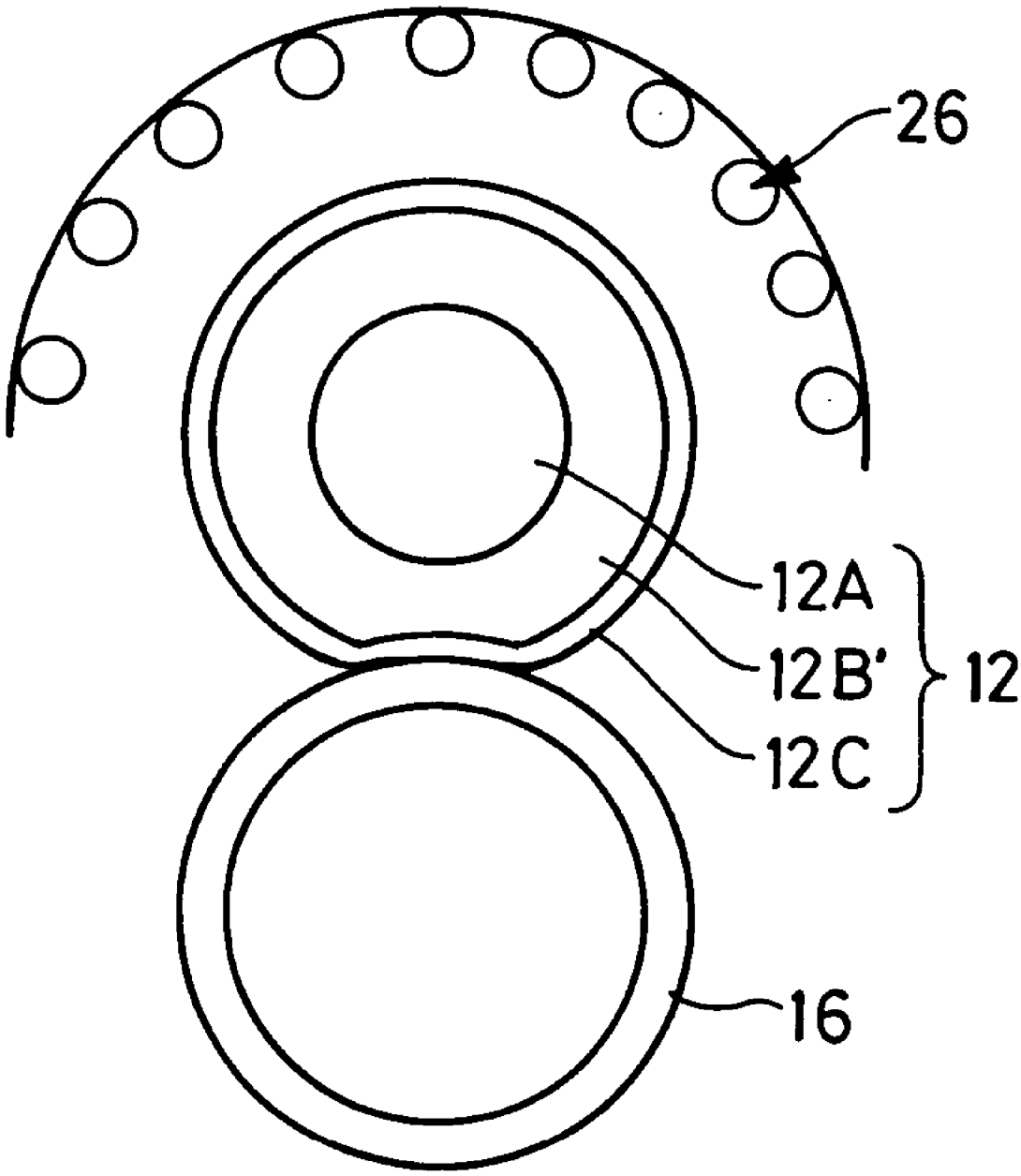
FIG. 9 is a sectional front view showing the structure of a fixing apparatus according to a third embodiment of the present invention.

With reference to FIG. 9, the third embodiment will first be described. In the third embodiment, a fixing roller 12 includes a core 12A, an elastic layer 12B' made of silicone rubber sponge and formed on the outer periphery of the core 12A at a thick thickness of 5 mm, and a thin metal sleeve 12C covering the outer periphery of the elastic layer 12B'.

Figure 10:
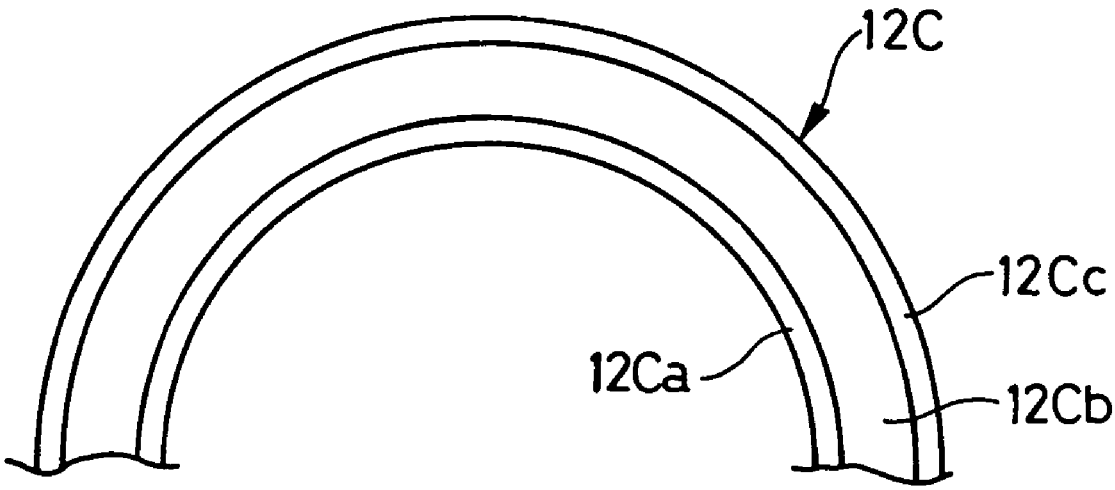
FIG. 10 is a sectional view of a thin metal sleeve of the fixing apparatus in FIG. 9.

The silicone sponge constituting the elastic layer 12B' is formed with closed cells. As shown in FIG. 10, the thin metal sleeve 12C in the third embodiment includes a sleeve body 12Ca made of electroformed nickel and having a thickness of 35 μm, a silicone rubber layer 12Cb coated over the entire outer periphery of the sleeve body 12Ca at a thickness of 200 μm, and a releasing layer 12Cc made of PFA resin and coated over the entire outer periphery of the silicone rubber layer 12Cb at a thickness of 30 μm.

A heating source in the third embodiment is composed of an electromagnetic induction heater 26 disposed close to and spaced apart from the outer peripheral surface of the fixing roller 12. While not illustrated in detail, a pressing roller 16 in the third embodiment includes a thin-walled metal core, and a thin synthetic resin layer coated on the outer periphery of the core.

According to the third embodiment constructed as described above, the electromagnetic induction heater 26 acts to generate heat in the electroformed-nickel sleeve body 12Ca of the thin sleeve 12C formed on the outer peripheral surface of the fixing roller 12 so as to allow the outer peripheral surface of the fixing roller 12 to have a given fixing temperature. Thus, as with the first and second embodiments, a wide nip width can be obtained with a low load, and an unfixed toner can be reliably fixed with the wide nip width while achieving downsizing of the apparatus and energy saving.

While the third embodiment has described the metal sleeve 12C for generating heat therein through the electromagnetic induction heater 26, the present invention is not limited to this structure. It is understood that a sleeve made of synthetic resin such as polyimide resin which contains finely dispersed materials for generating heat therein through electromagnetic induction (or for generating heat therein based on eddy currents caused by electromagnetic induction)

Figure 11:
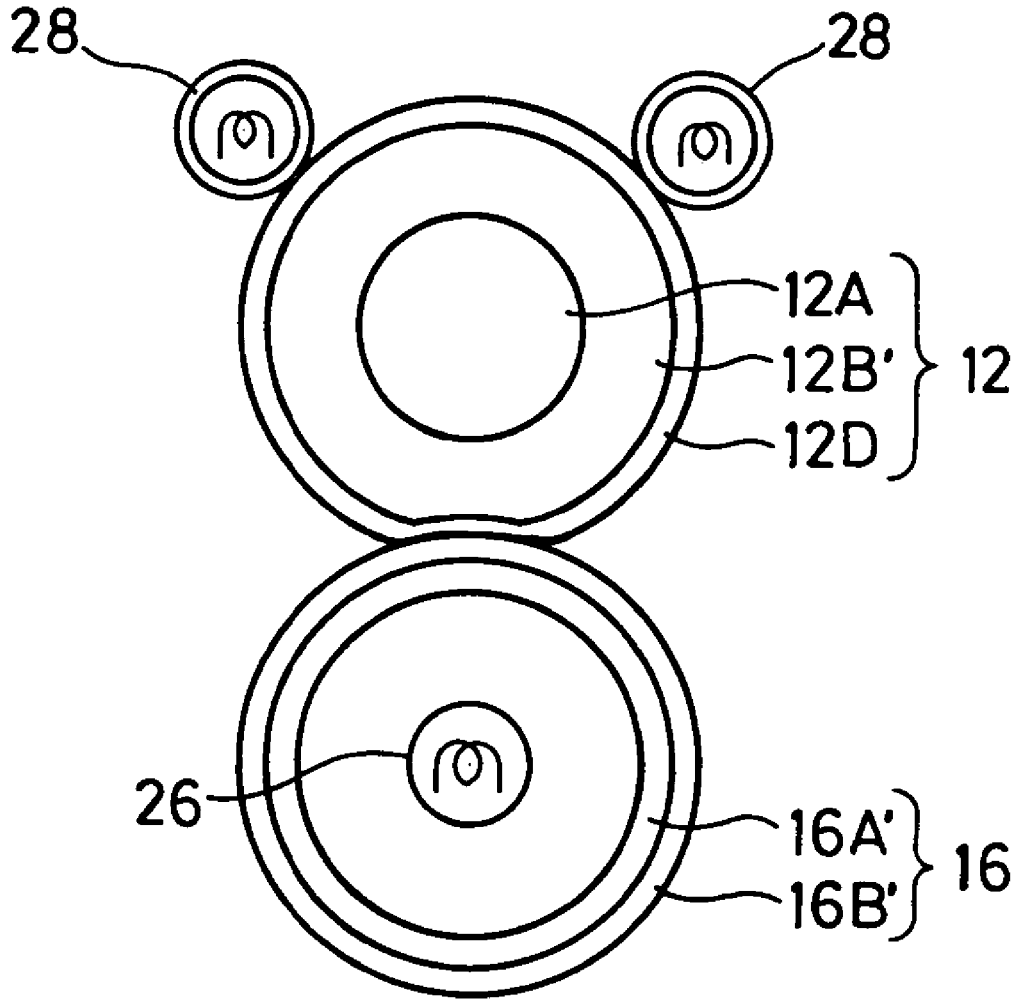
FIG. 11 is a sectional front view showing the structure of a fixing apparatus according to a fourth embodiment of the present invention.

With reference to FIG. 11, the fourth embodiment as another embodiment constructed to heat the outer peripheral surface of the fixing roller 12 from the outside of the fixing roller will be described below. In the fourth embodiment, a fixing roller 12 includes a core 12A, a thick elastic layer 12B' formed on the outer periphery of the core 12A at a thick thickness, and a releasing layer 12D covering the outer periphery of the elastic layer 12B' and made, for example, of PFA resin.

A heating source in the fourth embodiment is composed of a pair of heating rollers 28 in rotational contact with the outer peripheral surface of the fixing roller 12. The heating rollers 28 are spaced apart from one another along the circumferential direction of the fixing roller 12. While not illustrated in detail, each of the heating rollers 28 includes a hollow thin-walled core, and a halogen lamp embedded in the thin-walled core.

According to the fourth embodiment constructed as above, as with the third embodiment, the outer peripheral surface of the fixing roller 12 can be heated from the outside of the fixing roller up to a given temperature for the fixing operation so as provide the same effects as those in the aforementioned various embodiments.

As mentioned above in detail, the present invention can provide a fixing apparatus capable of increasing a nip width with a low load.

In addition, the present invention can provide a fixing apparatus capable of downsizing the apparatus and/or saving energy, while increasing a nip width.

What is claimed is:

1. A fixing apparatus comprising:

a fixing roller;

heating means for allowing the outer peripheral surface of said fixing roller to have a given temperature capable of performing a fixing operation;

a pressing roller in rotational contact with said fixing roller; and a biasing member for allowing said pressing roller to be brought into press contact with said fixing roller at a given pressure, wherein said fixing apparatus is operable to allow a sheet with a surface supporting an unfixed toner thereon to pass through a rotational contact region along one direction so as to fix said unfixed toner onto said sheet, said fixing apparatus being characterized in that:

said fixing roller is disposed on the side of said sheet surface supporting said unfixed toner;

said pressing roller is disposed on the opposite side of said fixing roller with respect to said sheet; and said biasing member comprising a pair of coil springs applying a biasing force to said pressing roller in a direction intersecting with a plane connecting the respective center axes of said fixing roller and said pressing roller, each of the coil springs having one end engaged with a corresponding one of both ends of the pressing roller.

2. The fixing apparatus as defined in claim 1, which satisfies the following formula:

$$+5° < \theta < +80°,$$

wherein θ is an angle defined between X and Y, said X being an axis connecting the respective centers of said fixing and pressing rollers, said Y being an axis along a direction in which said pressing roller is biased toward said fixing roller in said rotational contact region, and a positive sign assigned to said angle θ means that said angle θ is defined between said axis X and said axis Y located on a sheet-feeding side with respect to said axis X.

3. The fixing apparatus as defined in claim 1, which satisfies the following formula:

$$-5° < \theta < -80°,$$

wherein θ is an angle defined between X and Y, said X being an axis connecting the respective centers of said fixing and pressing rollers, said Y being an axis along a direction in which said pressing roller is biased toward said fixing roller in said rotational contact region, and a negative sign assigned to said angle θ means that said angle θ is defined between said axis X and said axis Y located on a sheet-discharging side with respect to said axis X.

4. The fixing apparatus as defined in claim 1, wherein said fixing roller has a hard surface portion, and said pressing roller has an elastic surface portion.

5. The fixing apparatus as defined in claim 4, which further includes:

releasing means for releasing the sheet attached on the outer peripheral surface of said fixing roller after passing through said rotational contact region, from the outer peripheral surface of said fixing roller.

6. The fixing apparatus as defined in claim 5, wherein said releasing means is disposed in contact with the outer peripheral surface of said fixing roller.

7. The fixing apparatus as defined in claim 5, wherein said releasing means is disposed opposed to the outer peripheral surface of said fixing roller in a non-contact manner.

8. The fixing apparatus as defined in claim 4, wherein said pressing roller includes a core, said elastic surface portion is made of silicone rubber and formed on the outer periphery of said core, and the thickness of said elastic surface portion is arranged to provide said rotational contact region.

9. The fixing apparatus as defined in claim 4, wherein said heating means includes a heater embedded in said fixing roller, and said heater is operable to heat the outer peripheral surface of said fixing roller from the inside of said fixing roller.

10. The fixing apparatus as defined in claim 1, wherein each of said fixing and pressing rollers has an elastic surface portion.

11. The fixing apparatus as defined in claim 10, wherein respective said elastic surface portions of said fixing and pressing rollers have the same elasticity to allow said rotational contact region to be formed as a 2-dimensional configuration.

12. The fixing apparatus as defined in claim 10, wherein said elastic surface portion of said fixing roller has a higher elasticity than that of said elastic surface portion of said pressing roller.

13. The fixing apparatus as defined in claim 10, wherein each of said fixing and pressing rollers includes a core, each of said elastic surface portions of said fixing and pressing roller is made of silicone rubber and formed on the outer periphery of corresponding said core, and the total thickness of said elastic surface portions is arranged to provide said rotational contact region.

14. The fixing apparatus as defined in claim 13, wherein said heating means includes a heater embedded in said fixing roller, and said heater is operable to heat the outer peripheral surface of said fixing roller from the inside of said fixing roller.

15. The fixing apparatus as defined in claim 14, wherein said heating means further includes an auxiliary heater embedded in said pressing roller, and said auxiliary heater is operable to heat the sheet which is passing through said rotational contact region, from the sheet surface having no unfixed toner.

16. The fixing apparatus as defined in claim 1, wherein said fixing roller has an elastic surface portion, and said pressing roller has a hard surface portion.

17. The fixing apparatus as defined in claim 16, wherein said fixing roller includes a core, said elastic surface portion is made of silicone rubber and formed on the outer periphery of said core, and the thickness of said elastic surface portion is arranged to provide said rotational contact region.

18. The fixing apparatus as defined in claim 16, wherein said heating means includes at least one heating roller in rotational contact with the outer peripheral surface of said fixing roller, and said heating roller is operable to heat the outer peripheral surface of said fixing roller from the outside of the fixing roller.

19. The fixing apparatus as defined in claim 18, wherein said heating roller includes a metal sleeve, and a heater housed in said sleeve.

20. The fixing apparatus as defined in claim 18, wherein said heating means further includes an auxiliary heater embedded in said pressing roller, and aid auxiliary heater is operable to heat the sheet which is passing through said rotational contact region, from the sheet surface having no unfixed toner.

21. The fixing apparatus as defined in claim 1, wherein aid fixing roller includes a core, an elastic layer formed on the outer periphery of said core, and a thin metal sleeve formed on the outer periphery of said elastic layer.

22. The fixing apparatus as defined in claim 21, wherein said heating means includes an induction-heating device disposed opposed to the outer peripheral surface of said fixing roller in a non-contact manner, and said induction-heating device is operable to induction-heat said thin metal sleeve.

23. The fixing apparatus as defined in claim 22, wherein said metal sleeve is made of electroformed nickel material.

24. The fixing apparatus as defined in claim 1, wherein said fixing roller includes a core, an elastic layer disposed on the outer periphery of said core, and a thin sleeve disposed on the outer periphery of said elastic layer and made of synthetic resin material which dispersedly contains a material for generating heat therein through electromagnetic induction, said heating means includes an induction-heating device disposed opposed to the outer peripheral surface of said fixing roller in a non-contact manner, and said induction-heating device is operable to induction-heat said thin sleeve.

25. The fixing apparatus as defined in claim 24, wherein said synthetic resin material is polyimide resin.

* * * * *